United States Patent [19]

Sakamoto

[11] Patent Number: 4,676,301

[45] Date of Patent: Jun. 30, 1987

[54] METHOD OF CLEANING AN INNER SURFACE OF A HEAT TRANSFER TUBE IN A HEAT-EXCHANGER

[75] Inventor: Takao Sakamoto, Iwaki, Japan

[73] Assignee: Yamato System Engineer Co., Ltd., Ibaragi, Japan

[21] Appl. No.: 844,075

[22] Filed: Mar. 26, 1986

[30] Foreign Application Priority Data

Mar. 30, 1985 [JP] Japan ..... 60-67468

[51] Int. Cl.[4] ..... F28G 1/02

[52] U.S. Cl. ..... 165/95; 15/3.52; 15/104.19; 15/104.2

[58] Field of Search ..... 165/94, 95; 15/3.51, 15/3.52, 104.19, 104.2

[56] References Cited

U.S. PATENT DOCUMENTS

| | | | |
|---|---|---|---|
| 258,426 | 5/1882 | Jewell | 15/3.52 |
| 535,664 | 3/1895 | Bott | 15/3.52 |
| 2,408,240 | 9/1946 | Stone | 15/3.52 X |
| 4,562,886 | 1/1986 | Holm | 165/95 X |

*Primary Examiner*—Albert W. Davis, Jr.
*Assistant Examiner*—Peggy Neils

[57] ABSTRACT

A method of cleaning an inner surface of a heat transfer tube for removing deposited scale, such as fur and rust therefrom is disclosed, in which a cleaning brush element with a string is flowed at its inverted state through the tube together with a cooling water, and thereafter the string is pulled for withdrawing the brush element against the flowing movement of the cooling water while contacting a brush of the brush element with the inner surface of the heat transfer tube.

6 Claims, 3 Drawing Figures

METHOD OF CLEANING AN INNER SURFACE OF A HEAT TRANSFER TUBE IN A HEAT-EXCHANGER

FIELD OF THE INVENTION

This invention relates to a method of cleaning an inner surface of a heat transfer tube in a heat-exchanger, more particularly to such a method for cleaning the inner surface of the heat transfer tube and removing scale, such as fur and rust, deposited thereon which often occurs in an atomic power plant using sea water as a cooling means.

BACKGROUND OF THE INVENTION

Such a heat transfer tube in the heat-exchanger is generally contaminated on its inner surface with scale, (such as fur and rust) during operation, which must be cleanend off periodically to prevent decrease of efficiency.

Japanese Patent Publication No. 29929/69 discloses an automatic cleaning apparatus, in which a cleaning brush is placed in a receiving frame arranged at an end of the tube and is moved in the tube by switching the flowing direction of water. The apparatus of such a type has disadvantages, however, in that the flowing direction of water must be forcibly changed and the apertures provided on the receiving frame for the brush may deteriorate smoothness of the water flow.

Japanese Patent Publication No. 11662/74 discloses a method of removing scale, in which a linear and flexible cleaning body of streamer type is flowed in a jacket of spiral construction. In this case, however, complete removal of deposited scale is difficult because of flexibility of the cleaning body itself.

Japanese Opend Patent Application No. 158995/84 teaches a cleaning apparatus similar to the former one, in which a string is attached to the brush for preventing escape of the latter and for improving stability and reliability of the receiving frame. This measure can not eliminate the necessity of forcible switching of the water flow and the deterioration of smoothness of the water flow. Further, smoothness movement of the brush is inconsistent with higher resistance for facilitating removal of deposited scale, and the removed scale is located in front of the brush to inhibit its smooth movement.

Another method is known, in which spongy balls are floated in a heat-exchanging water and passed through the heat transfer tube to be cleaned. In this case, however, special equipment is necessary for placing and removing the spongy balls, resulting in a larger apparatus. Further, damage and wear of the balls must be determined for replacement with new ones, resulting in troublesome management. In order to solve these problems Japanese U. M. Publication No. 35584/77 has proposed such an apparatus of ball-recycling type, in which air in the balls is removed and replaced with sufficient water to provide an ideal cleaning condition, but which cannot solve the problems basically.

Accordingly, an object of the invention is to eliminate the above disadvantages and to ensure effective and automatic cleaning of each one of the heat transfer tubes arranged in parallel.

SUMMARY OF THE INVENTION

For achieving the above objective, the invention provides a method of cleaning an inner surface of each one of heat transfer tubes contained in a heat-exchanger, in which a cleaning brush element with a string is flowed at an inverted state of its brush through the heat transfer tube together with a flowing fluid, and thereafter the string is pulled for withdrawing the brush element against the flowing fluid while contacting the brush with the inner surface of the heat transfer tube.

Thus, complete cleaning in the heat transfer tube may be achieved during operation thereof without decrease of heat-exchanger efficiency and without influence on resistance of the water flow. Further, because the space required for the operating equipment being small, such equipment may be placed so as to form an adjunct of the heat-exchanger.

The invention will be described in more detail for better understanding with reference to the accompanying drawings.

PREFERRED EMBODIMENTS OF THE INVENTION

Figure 1:
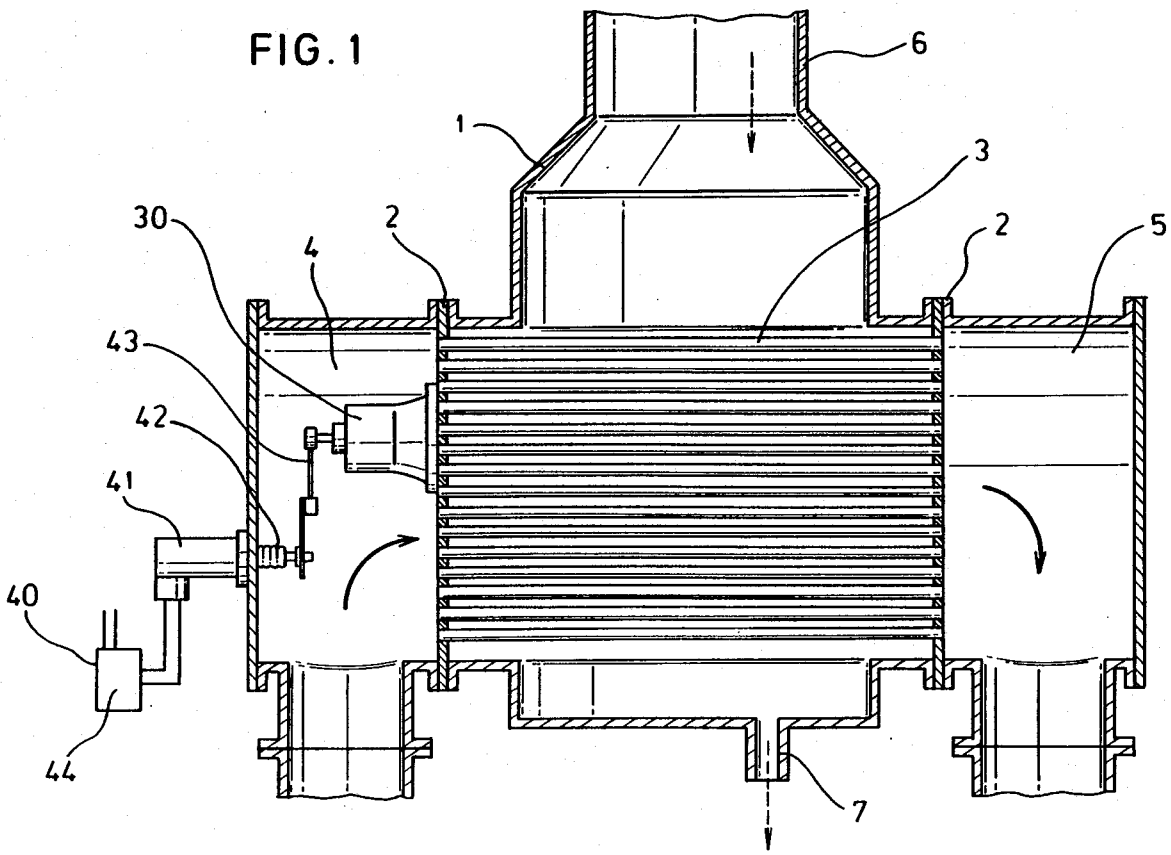
FIG. 1 is a sectional view of the heat-exchanger.

In the drawing, a numerical reference 1 represents a framework of a heat-exchanger arranged in, for example, an atomic power plant, which contains a tubular plate 2 for supporting a plurality of heat transfer tubes 3 arranged in a predetermined pitch. A cooling water (sea water) is fed into a water inlet chamber 4 on the inlet side of the heat transfer tubes 3 and passed through the tubes 3 into a water outlet chamber 5 on the outlet side of the tubes 3. On the other hand, a steam fed through a steam inlet 6 above the framework 1 is heat-exchanged with the cooling water of the tubes 3 for condensation and discharged as a condensate from a condensate outlet 7 below the framework 1.

Scale deposited on an inner surface of each tube 3, such as fur and rust from the cooling water, during operation is cleaned off by means of a cleaning brush element 10 moving in the tube 3. The brush element 10 is arranged in the water inlet chamber 4 and flowed through the tube 3 together with the cooling water. Thereafter, a string 28 secured to the brush element 10 is pulled for withdrawing the latter against the water flow through tube 3 while brush 11 of the element 10 engages the inner surface of the tube 3 thereby to remove the scale.

For this purpose, as illustrated, a cleaning apparatus comprises a control means 20 for controlling the flowing and withdrawing movement of the brush element 10 in the tube 3, a cleaning unit 30 containing a plurality of brush elements 10 positioned to correspond to the pitch of the heat transfer tubes 3 and received in the water inlet chamber 4, and a positioning means 40 externally of the water inlet chamber 4 for controlling the control means 20.

Figure 2:
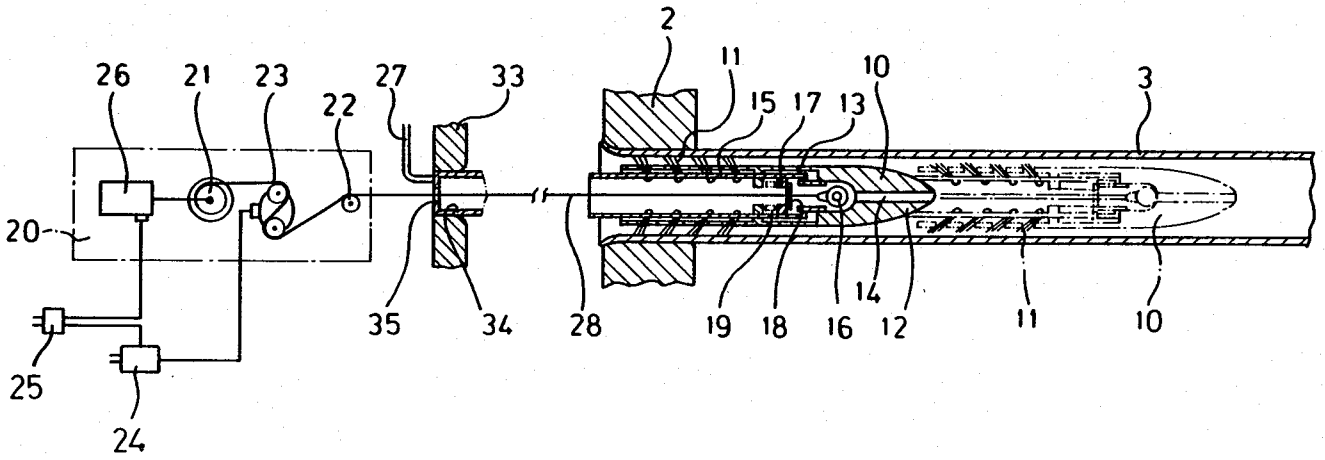
FIG. 2 is a sectional view of the apparatus used in the invention, showing the flowing and withdrawing states of the cleaning brush element in the heat transfer tube.

As shown in phantom lines in FIG. 2, brush 11 of brush element 10 is in an inoperative depressed state during the flowing movement of element 10 together with the cooling water in the tube 3 for ensuring unimpeded smooth movement of element 10 into tube 3, while the brush 11 is moved to its operative raised state during the withdrawal operation as shown in solid lines in FIG. 2 by pulling the string 28 for moving the brush into engagement with the inner surface of tube 3 to remove deposited scale from the inner surface of the tube 3. The brush element 10 is constructed in such a way that it exhibits a bullet shape having a smaller diameter than the heat transfer tube 3, defining thereby an annular passage between brush element 10 and tube 3, that its rear portion is open to form a receiving portion 13, that its main body 12 is provided at a front portion with a through-hole 14, that a brush sleeve 15 is received in the receiving portion 13, which is implanted with the brush 11 passing outwardly through a wall of the main body 12, that a hollow ball connected to a front end of the string 28, which is associated with the control means 20, is arranged in the receiving portion 13 in free contact relation to an inner open end of the through-hole 14, that a stopper 18 contacted to an abutment engaging portion 17 of the brush sleeve 15 is secured to the string 28, and that a spring 19 is arranged between the main body 12 and the brush sleeve 15. For operation, the string 28 is pulled against an elastic force of the spring 19 to withdraw the brush sleeve 15 relative to the main body 12, thereby to raise the brush 11 in a slide contact relation to the inner surface of the heat transfer tube 3.

The control means 20 comprises a bobbin 21 for winding and receiving the string 28 connected to the brush element 10, a guide wheel 22 for unwinding the string 28 and keeping a constant unwinding position, a tension detector arranged between the bobbin 21 and the guide wheel 22 for detecting tension of the string 28, a tension-detecting controller 24 for signalizing the tension detected by the tension detector 23 and outputting the resulting tension signal, and a control motor 26, such as a direct-current servo-motor, for receiving the tension signal and controlling rotation of the bobbin 21 through a winding controller 25.

In order to clean the heat transfer tube 3 by use of the cleaning brush element 10 and the control means 20, tension of the string 28 is released to permit unwinding of the string to allow the brush element 10 to move up to an inner inlet end of the tube 3 and then to flow into the latter together with the cooling water. In this situation, the hollow ball 16 blocks the through-hole 14 and the brush sleeve is in a position relative to the main body 12 to cause the brush 11 to lie down, as shown in dot-dash lines in FIG. 2, so that the brush element 10 can flow at the same velocity as the flow rate of the cooling water. Upon terminating unwinding movement of the string, the string is tensioned as hollow body 16, attached to the string, is separated from through-opening 14. When thus tensioned the string 28 is wound up causing the stopper 18 to engage abutment portion 17 to urge the latter rearwardly against the bias of spring 19 whereby to urge the sleeve 15 (connected with abutment portion 17) rearwardly relative to the main body 12, which relative movement is effective to raise the brush to its operative position as shown in solid lines in FIG. 2. On detecting tension of the string the control motor 26 is driven to rotate the bobbin 21 for rewinding the string 28 in order to bring the brush 11 into the slide contact relation to the inner surface of the tube 3, thereby to remove the deposited scale therefrom. During withdrawal of the brush element 10, the cooling water can freely flow through the uncovered hole 14 which occurs when hollow ball 16 is separated from opening hole 14, thereby to prevent heavy loading.

When the brush element 10 is flowing in the tube 3, tension of the string 28 is detected by the tension detector 23 and the tension-detecting controller 24 to confirm that the brush element 10 is being withdrawn toward the inlet of the tube 3, and after reaching an appropriate position the tension is released to again allow the brush element 10 to flow in the tube 3 with the brush in depressed position. Thus, an operator may automatically confirm whether the brush element 10 is positioned at the inlet of the heat transfer tube 3 to be cleaned or not. Further, release of the tension enables the brush element 10 to flow automatically into transfer tube 3.

Furthermore, the brush element 10 may be retained at any desired position within the tube 3 by the previously disclosed control. This control may be achieved by registering an unwound length of the string 28, corresponding to a desired position of the brush element in the tube, 3 in the tension detector 23, the tension-detecting controller 24, the winding controller 25 and the control motor 26. Thus, if the cleaning information is registered, the control motor 26 may be driven and controlled externally by previous instructions, resulting in automatic operation.

As shown in FIG. 2, when the brush element 10 reaches the inner inlet end of the tube 3, a gas or liquid may be ejected from a nozzle 27, if desired, to accelerate the flowing movement of the brush element 10 in the tube 3.

Figure 3:
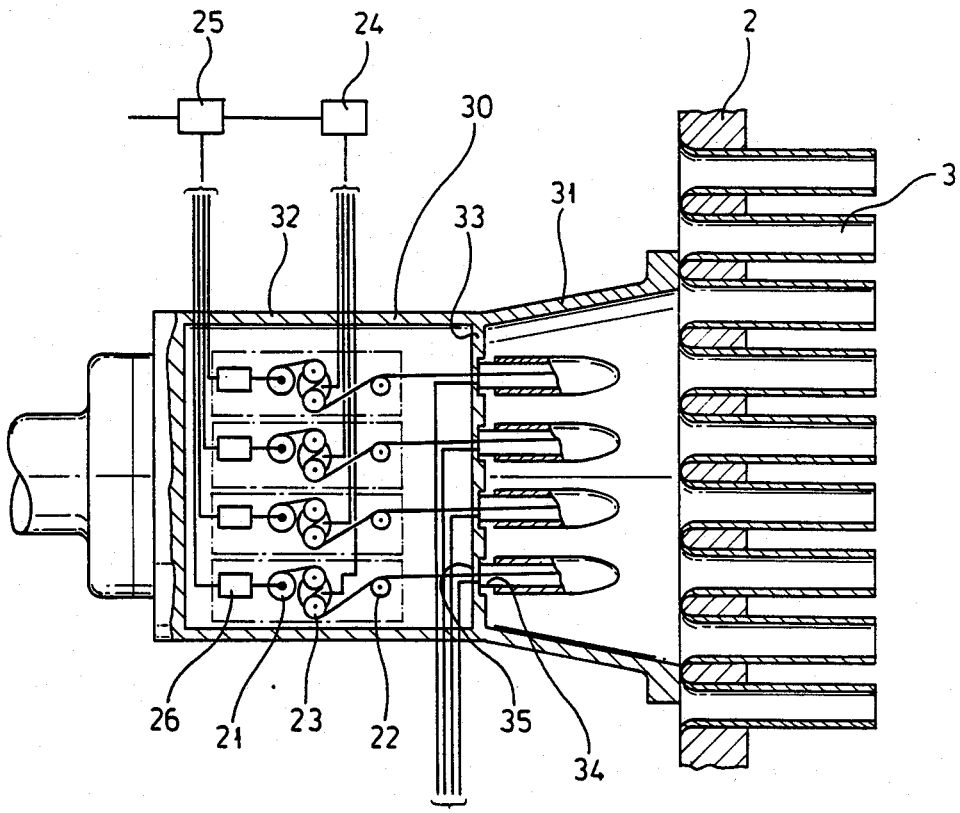
FIG. 3 is a sectional view of a cleaning unit used in the invention.

As shown in FIG. 3, the cleaning unit 30 comprises a plurality of the brush element 10 positioned to correspond to the pitch of the heat transfer tubes 3. The unit 30 has an open end of a trumpet shape in contact with the tubular plate 2. Further, the unit 30 defines a front space comprising receiving chamber 31 in which the brush elements 11 are disposed, and a rear space comprising a unit chamber 32 in the form of a box for accommodating a corresponding number of the bobbins 21, the guide wheels 22, the tension detectors 23 and the control motors 26, respectively. The receiving chamber 31 and the unit chamber 32 are separated by a supporting wall 33 which at its front is provided with recesses 34 for supporting the brush elements 10. Each recess 34 is provided with a hole 35 for liquid-tightly passing the string 28. The cleaning unit 30 thus constructed is received in the water inlet chamber 4 of the heat exchanger as shown in FIG. 1. As previously described, the brush elements 10 correspond to the pitch of the tubes 3, so that guidance of each brush element 10 to the inner inlet end of the tube 3 may be facilitated to ensure rapid operation.

The cleaning unit 30 itself may be controlled externally by a positioning means 40. As shown in FIG. 1, a driving means 41 fixed to an outer wall of the water inlet chamber 4 is joined to a bendable arm 43 through a stretchable arm 42 within the water inlet chamber 4. The arm 43 at its end supports a rear portion of the cleaning unit 30 received in the chamber 4 and is freely controlled for its rotation and bending angle through the driving means 41 driven by the external control means 44 and the stretchable arm 42, thereby to control the positioning of the cleaning unit 30 relative to the set of heat transfer tubes 3. The cleaning unit 30 including the plural heat transfer tubes 3 may be operated by the positioning means 40, so that small group of the tubes 3 may be selected to be cleaned repeatedly and continuously and then the unit 30 may be moved to another group of the tubes 3 to be cleaned. Thus, the apparatus as a whole may be compact with rapid and reliable operation.

Although the bobbin 21, the guide wheel 22, the tension detector 23 and the control motor 26 for rewinding or unwinding the string 28 are illustrated to be received in the cleaning unit 30, they may be arranged externally and connected to the string 28 passing through the wall of the water inlet chamber 4.

In accordance with the invention, the cleaning operation may be achieved, utilizing the flowing movement of the cooling water in the heat transfer tubes 3, so that the performance and capacity of the heat-exchanger are not reduced, that the resistance of the cooling water in the water inlet chamber 4 may be neglected, and that only a limited space is required for additional equipment during an actual working cycle.

Further, the brush element 10 with the string 28 may be flowed through the heat transfer tube 3 by utilizing the cooling water flow without any other moving means, while the movement of the brush element 10 in the tube 3 may be very smooth due to the lying down state of the brush 11 and does not hinder the water flow.

Moreover, the brush element 10 may be pulled by the string 28 for withdrawal against the cooling water flow while raising the brush 11 in the slide contact relation to the inner surface of the tube 3, thereby to ensure the removal of the scale, such as fur and rust, deposited thereon and the flowing down of the scale in the opposite direction of the movement of the brush element 10, so that the brush 11 itself is not clogged and decreased in its function.

Although the invention has been described hereinabove with reference to the preferred embodiments, it will be appreciated to those skilled in the art that many variations and modifications may be made without departing from the spirit and scope of the invention.

What is claimed is:

1. A method of cleaning an inner surface of at least one heat transfer tube of a heat exchanger by way of a tubular cleaning brush element within said heat transfer tube through which a heat transfer fluid flows, said tubular cleaning brush element having a string attached thereto, said string being adapted to be unwound and wound for respectively enabling movement of said tubular brush cleaning element into said heat transfer tube preparatory to a cleaning operation and for cleaning of said heat transfer tube during withdrawal movement of said tubular cleaning brush element from said heat transfer tube, said tubular cleaning brush element including a sleeve therein carrying a brush movable as a function of positions of said sleeve relative to a main body portion of said cleaning brush element, said brush extending through openings in said main body portion for movement, during said relative movement between said sleeve and said main body portion, between an inoperative depressed position, out of engagement with said inner surface of said tubular heat transfer tube to be cleaned, and an operative raised position in engagement with said inner surface of said heat transfer tube, said method comprising flowing said tubular cleaning brush element into said heat transfer tube together with said heat exchange fluid flowing through the tube, said brush on said sleeve during said flowing of said tubular cleaning brush element into said heat transfer tube being in its inoperative depressed position, maintaining said string relatively free of tension during said flowing of said tubular cleaning brush element into said heat transfer tube by unwinding the string, terminating unwinding of the string and thereby said flowing of said tubular cleaning brush element into said heat transfer tube, whereby to tense said string, detecting tension on said string, and winding said string on detecting tension therein for effecting movement of said sleeve relative to said main body portion in a direction to move said brush to its operative raised position for a cleaning operation.

2. A method as claimed in claim 1, wherein when tension of the string is detected, the tubular brush element is withdrawn toward an inlet of the heat transfer tube, and thereafter releasing the tension on the string to allow the brush element to again flow in unison with its sleeve through the heat transfer tube and to stop at a controllable position in the heat transfer tube.

3. A method as claimed in claim 1, wherein a plurality of heat transfer tubes are provided in the heat exchanger, the tubes being arranged in a predetermined pitch, and providing a cleaning unit containing a plurality of said brushes arranged in a pitch corresponding to that of the heat transfer tubes, said cleaning unit being arranged in a water inlet chamber of the heat exchanger and externally controlled for its movement relative to said heat transfer tube.

4. A method as claimed in claim 2, wherein a plurality of heat transfer tubes are provided in the heat exchanger, the tubes being arranged in a predetermined pitch, and providing a cleaning unit containing a plurality of said brushes arranged in a pitch corresponding to that of the heat transfer tubes, said cleaning unit being arranged in a water inlet chamber of the heat exchanger and externally controlled for its movement relative to said heat transfer tube.

5. A method as claimed in claim 1, wherein the string has a floating ball attached to an end thereof, and maintaining the floating ball in sealing engagement with an opening in the tubular cleaning brush element to prevent flow of said heat exchange fluid through said opening during inward movement of the string during unwinding thereof, breaking said sealing engagement and winding the string to ensure continuous flow of heat exchange fluid through said heat transfer tube during the cleaning operation.

6. A method of cleaning an inner surface of at least one heat transfer tube of a heat exchanger by way of a tubular cleaning brush element within said heat transfer tube through which a heat transfer fluid flows, said tubular cleaning brush element having a string attached thereto, said string being adapted to be unwound and wound for respectively enabling movement of said tubular brush cleaning element into said heat transfer tube preparatory to a cleaning operation and for cleaning of said heat transfer tube during withdrawal movement of said tubular cleaning brush element from said heat transfer tube, said tubular cleaning brush element comprising two relatively movable parts, one of which carries a brush extending through openings in another of said two relatively movable parts, said brush as a function of movement of said one part relative to said another part being movable between an inoperative depressed position, out of engagement with said inner surface of said heat transfer tube, and an operative raised position, in engagement with said inner surface of said heat transfer tube, said method comprising flowing said tubular cleaning brush element into said heat transfer tube together with said heat exchange fluid flowing through the tube, said brush during said flowing of said tubular cleaning brush element into said heat transfer tube being in its inoperative depressed position, maintaining said string relatively free of tension during said flowing of said tubular cleaning brush element into said heat transfer tube by unwinding the string, terminating unwinding of the string and thereby said flowing of said tubular cleaning brush element into said heat transfer tube whereby to tense the string, detecting tension in the string, and winding said string on detecting tension therein for effecting movement of said one part relative to said another part in a direction to move said brush to its operative raised position for a cleaning operation.

* * * * *